US009511905B2

(12) United States Patent
Tsujiguchi et al.

(10) Patent No.: US 9,511,905 B2
(45) Date of Patent: Dec. 6, 2016

(54) SYNTHETIC RESIN CONTAINER CLOSURE AND COMBINATION OF SAME AND CONTAINER

(71) Applicant: NIPPON CLOSURES CO., LTD., Tokyo (JP)

(72) Inventors: Youichi Tsujiguchi, Kanagawa (JP); Shinji Ooka, Kanagawa (JP); Shinji Oomori, Kanagawa (JP); Mitsuo Kumata, Kanagawa (JP); Hiroomi Matsutani, Kanagawa (JP); Yuji Tomitaka, Kanagawa (JP); Manabu Aihara, Kanagawa (JP)

(73) Assignee: NIPPON CLOSURES CO., LTD., Tokyo (JP)

( * ) Notice: Subject to any disclaimer, the term of this patent is extended or adjusted under 35 U.S.C. 154(b) by 47 days.

(21) Appl. No.: 14/364,760

(22) PCT Filed: Sep. 21, 2012

(86) PCT No.: PCT/JP2012/074181
§ 371 (c)(1),
(2) Date: Jun. 12, 2014

(87) PCT Pub. No.: WO2013/088809
PCT Pub. Date: Jun. 20, 2013

(65) Prior Publication Data

US 2014/0319093 A1 Oct. 30, 2014

(30) Foreign Application Priority Data

Dec. 16, 2011 (JP) ..... 2011-276312

(51) Int. Cl.
*B65D 41/00* (2006.01)
*B65D 41/34* (2006.01)
*B65D 1/02* (2006.01)

(52) U.S. Cl.
CPC ..... *B65D 41/3428* (2013.01); *B65D 1/0246* (2013.01); *B65D 41/3447* (2013.01); *B65D 2101/0038* (2013.01)

(58) Field of Classification Search
CPC . B65D 41/32; B65D 41/3442; B65D 41/3447; B65D 2101/0023; B65D 2101/0092
(Continued)

(56) References Cited

U.S. PATENT DOCUMENTS 3,329,295 A * 7/1967 Fields ..... B65D 41/3447 215/252
4,503,985 A 3/1985 Swartzbaugh et al.
(Continued)

FOREIGN PATENT DOCUMENTS

CA 2107055 9/1993
EP 0228618 7/1987
(Continued)

OTHER PUBLICATIONS

Search report from E.P.O., mail date is Jul. 6, 2015.
International Search Report issued Nov. 13, 2012 in PCT/JP2012/074181 and English language translation thereof.

*Primary Examiner* — Anthony Stashick
*Assistant Examiner* — Ernesto Grano
(74) *Attorney, Agent, or Firm* — Greenblum & Bernstein, P.L.C.

(57) ABSTRACT

A synthetic resin container closure does not render required initial torque and required secondary torque for unsealing excessively high, and but can fully reliably prevent slipping-out, a phenomenon where a locking device ascends while elastically climbing over a locking jaw portion, without causing breakage of a circumferential breakable line, at the time of unsealing. Such a synthetic resin container closure and a combination of the synthetic resin container closure and a container are provided. An inverted truncated cone-
(Continued)

shaped fitting surface extending upwards at a radially outward incline from the base edge of an upper surface of the locking device is disposed in the inner peripheral surface of a tamper evident bottom section demarcated below the circumferential breakable line formed in a skirt wall.

3 Claims, 8 Drawing Sheets

(58) Field of Classification Search
USPC ..... 215/44
See application file for complete search history.

(56) References Cited

U.S. PATENT DOCUMENTS

| | | | | |
|---|---|---|---|---|
| 4,567,933 | A | 2/1986 | Lauener et al. | |
| 4,567,993 | A * | 2/1986 | Albrecht | B65D 41/3447 215/252 |
| 4,744,480 | A * | 5/1988 | Luch | B26F 1/18 215/252 |
| 4,890,754 | A * | 1/1990 | Dorn | B65D 41/3447 215/252 |
| 4,895,265 | A * | 1/1990 | Luch | B26F 1/18 215/43 |
| 5,402,901 | A | 4/1995 | Carvalheiro et al. | |
| 5,648,037 | A | 7/1997 | Franchet et al. | |
| 5,755,346 | A * | 5/1998 | Ekkert | B65D 41/3447 215/252 |
| 5,967,351 | A | 10/1999 | Ekkert | |
| 6,089,390 | A | 7/2000 | Druitt et al. | |
| 6,325,225 | B1 | 12/2001 | Druitt et al. | |
| 6,705,479 | B2 * | 3/2004 | Druitt | B65D 41/3447 215/252 |
| 2002/0030031 | A1 | 3/2002 | Druitt et al. | |

FOREIGN PATENT DOCUMENTS

| | | |
|---|---|---|
| EP | 0688724 | 12/1995 |
| EP | 0799772 | 10/1997 |
| FR | 2701248 | 8/1994 |
| JP | 62-538 | 1/1987 |
| JP | 5-13735 | 4/1993 |
| JP | 5-26055 | 6/1993 |
| JP | 8-509188 | 10/1996 |
| JP | 2011-136728 | 7/2011 |
| JP | 2011-143942 | 7/2011 |

* cited by examiner

SYNTHETIC RESIN CONTAINER CLOSURE AND COMBINATION OF SAME AND CONTAINER

TECHNICAL FIELD

This invention relates to a synthetic resin container closure having a locking means disposed on the inner peripheral surface of a tamper evident bottom section, and a combination of such a synthetic resin container closure and a container having a locking jaw portion formed on the outer peripheral surface of a mouth-and-neck portion.

BACKGROUND ART

As is well known, combinations of containers formed from glass, synthetic resins, or metal sheets, and container closures formed from synthetic resins, used for beverages, have found wide practical use. The container has a cylindrical mouth-and-neck portion, and an external thread and a locking jaw portion located below the external thread are formed on the outer peripheral surface of the mouth-and-neck portion. The container closure, on the other hand, has a circular top panel wall, and a cylindrical skirt wall extending downwardly from the peripheral edge of the top panel wall. The skirt wall has, formed therein, a circumferential breakable line extending in the circumferential direction, and the skirt wall is divided into a main section above the breakable line and a tamper evident bottom section below the breakable line. An internal thread to be screwed onto the external thread of the mouth-and-neck portion is formed on the inner peripheral surface of the main section of the skirt wall, and a locking means is disposed on the inner peripheral surface of the tamper evident bottom section of the skirt wall.

After a beverage is filled into the container, the mouth-and-neck portion of the container is fitted with the container closure, and the container closure is rotated in a closing direction to screw the internal thread of the container closure onto the external thread of the mouth-and-neck portion. In this manner, the container closure is mounted on the mouth-and-neck portion to seal the mouth-and-neck portion. The locking means disposed on the tamper evident bottom section of the skirt wall elastically climbs over the locking jaw portion of the mouth-and-neck portion, and settles below the locking jaw portion. In unsealing the mouth-and-neck portion in order to consume the beverage, the container closure is rotated in an opening direction. By so doing, the screwing between the external thread and the internal thread is released. In accordance with the release of the screwing, the container closure is allowed to ascend relative to the mouth-and-neck portion. Once the container closure is somewhat raised, the locking means disposed on the tamper evident bottom section of the skirt wall is stopped in engagement with the lower surface of the locking jaw portion of the mouth-and-neck portion. Thus, the tamper evident bottom section is inhibited from ascending. As the rotation of the container closure in the opening direction is continued, stress caused to the circumferential breakable line formed in the skirt wall breaks the circumferential breakable line. As a result, the tamper evident bottom section of the skirt wall is separated from the main section. (Alternatively, if an axial breakable line is formed in the tamper evident bottom section, the axial breakable line is broken to transform the tamper evident bottom section from an endless annular form into a strip form having an end, and the tamper evident bottom section continues to be connected to the main section partly in the circumferential direction without being completely separated from the main section.) When the rotation of the container closure in the opening rotational direction is continued, the container closure is removed from the mouth-and-neck portion, with the tamper evident bottom section remaining (alternatively, the entire container closure including the tamper evident bottom section is removed from the mouth-and-neck portion), whereby the mouth-and-neck portion is opened.

The locking means disposed on the inner peripheral surface of the tamper evident bottom section of the skirt wall can be composed of a plurality of protrusions projecting radially inwardly with spacing in the circumferential direction, or an annular ridge extending uninterruptedly in the circumferential direction and projecting in the radial direction. The amount of projection of the protrusions or the ridge is limited to a relatively small value in order to prevent so-called forced extraction for release from a molding die from becoming excessive. When the mouth-and-neck portion is to be unsealed, therefore, the engagement of the locking means with the locking jaw portion of the mouth-and-neck portion becomes insufficient, and thus tends to cause so-called slipping-out, which means that the locking means elastically climbs over the locking jaw portion without causing breakage of the breakable line. To prevent such slipping-out, Patent Document 1 to be described below involves setting the inner diameter of a site above the locking means in the inner peripheral surface of the tamper evident bottom section at a value somewhat smaller than the outer diameter of the locking jaw portion of the mouth-and-neck portion, and interference-fitting the inner peripheral surface of the tamper evident bottom section to the outer peripheral surface of the locking jaw portion at the site above the locking means, thereby suppressing the elastic deformation or displacement of the tamper evident bottom section. As disclosed in the Patent Document 1, however, the interference fit of the inner peripheral surface of the tamper evident bottom section of the skirt wall onto the locking jaw portion of the mouth-and-neck portion, with the container closure being mounted on the mouth-and-neck portion as required for sealing of the mouth-and-neck portion, poses the following problems: Initial torque required when rotating the container closure in the opening direction in order to unseal the mouth-and-neck portion becomes excessively high, and tends to make it considerably difficult for a child or a female to perform an unsealing operation.

To solve the above-mentioned problems with the configuration disclosed in the Patent Document 1, Patent Document 2 to be described below makes the following disclosures: A loosely fitting upper portion with an inner diameter of d1 and a fitting lower portion with an inner diameter of d2, which is smaller than d1, are disposed above a locking means in the inner peripheral surface of a tamper evident bottom section. When a container closure is mounted, as required, on a mouth-and-neck portion of a container to seal the mouth-and-neck portion, the loosely fitting upper portion of the tamper evident bottom section is located opposite a locking jaw portion of the mouth-and-neck portion, and the tamper evident bottom section becomes loosely fitted to the locking jaw portion. When the container closure is somewhat rotated in an opening rotational direction and raised relative to the mouth-and-neck portion, the fitting lower portion of the tamper evident bottom section is located opposite the locking jaw portion and brought into an interference fit to the locking jaw portion. In such a disclosed configuration, an excessively high required initial torque is avoided. According to the experience of the present inventors, however, the following findings have been obtained: A step is present in a boundary region between the loosely fitting upper portion and the fitting lower portion of the tamper evident bottom section. Owing to the presence of this step, torque tends to increase sharply, when the container closure is raised relative to the mouth-and-neck portion and the fitting lower portion is fitted to the locking jaw portion. Moreover, the fitting lower portion engages the locking jaw portion over a relatively large area, and the locking means engages the lower surface of the locking jaw portion. Thus, the tamper evident bottom section is urged in a direction, in which it is inclined upwards and radially inwardly, whereby the pressing force of the fitting lower portion on the locking jaw portion is increased. Hence, so-called required secondary torque for breakage of a circumferential breakable line tends to become excessively high.

The present inventors' experience, moreover, has shown that in the conventional combinations, when the closure is mounted on the mouth-and-neck portion of the container to seal the mouth-and-neck portion, bridge portions in the circumferential breakable line tend to be broken.

PRIOR ART DOCUMENTS

Patent Documents

Patent Document 1: JP-UM-B-5-13735
Patent Document 2: JP-A-2011-143942

SUMMARY OF THE INVENTION

Problems to be Solved by the Invention

The present invention has been accomplished in the light of the above-mentioned facts. Its principal technical challenge is to provide a novel and improved synthetic resin container closure which does not render required initial torque and required secondary torque for unsealing excessively high, and which can fully reliably prevent slipping-out, a phenomenon where the locking means elastically climbs over the locking jaw portion and ascends, without causing breakage of the circumferential breakable line, at the time of unsealing; and a combination of such a synthetic resin container closure and a container.

Another technical challenge of the present invention is to provide a novel and improved combination of a container and a synthetic resin closure which minimizes the possibility of the breakage of the bridge portions in the circumferential breakable line when the closure is mounted on the mouth-and-neck portion of the container, in addition to solving the above principal technical challenge.

Means for Solving the Problems

The present inventors conducted in-depth studies and experiments, and have found that the above principal technical challenge can be solved by disposing an inverted truncated cone-shaped fitting surface, which extends upwards at a radially outward incline from the base edge of an upper surface of a locking means, in the inner peripheral surface of a tamper evident bottom section.

That is, according to a first aspect of the present invention, there is provided, as a synthetic resin container closure solving the above-mentioned principal technical challenge, a synthetic resin container closure which includes a circular top panel wall and a cylindrical skirt wall extending downwardly from a peripheral edge of the top panel wall, and in which a circumferential breakable line extending in a circumferential direction is formed in the skirt wall, the skirt wall is divided into a main section above the circumferential breakable line and a tamper evident bottom section below the circumferential breakable line, an internal thread is formed on an inner peripheral surface of the main section, and locking means is disposed on an inner peripheral surface of the tamper evident bottom section, wherein an inverted truncated cone-shaped fitting surface, which extends upwards at a radially outward incline from a base edge of an upper surface of the locking means, is disposed in the inner peripheral surface of the tamper evident bottom section.

According to another aspect of the present invention, there is provided, as a combination of a container and a synthetic resin container closure, adapted to solve the above principal technical challenge, a combination of a container and a synthetic resin container closure, in which the container has a cylindrical mouth-and-neck portion; and an external thread and a locking jaw portion located below the external thread are formed on an outer peripheral surface of the mouth-and-neck portion, and the synthetic resin container closure is mounted on the mouth-and-neck portion of the container, and includes a circular top panel wall and a cylindrical skirt wall extending downwardly from a peripheral edge of the top panel wall; a circumferential breakable line extending in a circumferential direction is formed in the skirt wall; the skirt wall is divided into a main section above the circumferential breakable line and a tamper evident bottom section below the circumferential breakable line; an internal thread to cooperate with the external thread of the mouth-and-neck portion is formed on an inner peripheral surface of the main section; and locking means to cooperate with the locking jaw portion of the mouth-and-neck portion is disposed on an inner peripheral surface of the tamper evident bottom section, wherein an inverted truncated cone-shaped fitting surface, which extends upwards at a radially outward incline from a base edge of an upper surface of the locking means, is disposed in the inner peripheral surface of the tamper evident bottom section of the synthetic resin container closure, and with the internal thread of the synthetic resin container closure being screwed onto the external thread of the mouth-and-neck portion to mount the synthetic resin container closure on the mouth-and-neck portion, thereby sealing the mouth-and-neck portion, an upper end edge of the fitting surface formed in the inner peripheral surface of the tamper evident bottom section is located to oppose an outer peripheral surface of the locking jaw portion of the mouth-and-neck portion.

Preferably, the fitting surface has an inclination angle of 3 to 15 degrees with respect to the central axis line. It is preferred that with the internal thread of the synthetic resin container closure being screwed onto the external thread of the mouth-and-neck portion to mount the synthetic resin container closure on the mouth-and-neck portion, thereby sealing the mouth-and-neck portion, a clearance x, at a minimum, of $0.0\ \text{mm} \leq x \leq 0.2\ \text{mm}$ be present between the outer peripheral surface of the locking jaw portion and the fitting surface.

In connection with the other technical challenge stated above, the present inventors have found, as a result of eager studies, that in the conventional combinations, when the locking ridge formed on the inner peripheral surface of the tamper evident bottom section of the closure climbs over the locking jaw portion formed on the outer peripheral surface of the mouth-and-neck portion of the container, a downward force is exerted on the circumferential breakable line through cooperation between the locking jaw portion and the locking ridge, and an upward force is also exerted on the circumferential breakable line through cooperation between the internal thread formed on the inner peripheral surface of the main section of the skirt wall and the external thread formed on the outer peripheral surface of the mouth-and-neck portion of the container, with the result that the bridge portions in the breakable line are broken. Based on these findings, the present inventors have found that the other technical challenge can be solved by setting the axial clearance C between the external thread and the internal thread, which has been set to be smaller than the axial effective width W of the locking jaw portion in the conventional combinations, at a value equal to or greater than the axial effective width W of the locking jaw portion (i.e., $C \geq W$). It is preferred for the axial clearance C to be larger than the axial effective width W by 0.0 to 0.7 mm ($C-W=0.0$ to 0.7 mm).

Effects of the Invention

In the present invention, as the synthetic resin container closure is raised relative to the mouth-and-neck portion of the container at the time of unsealing, the fitting surface of the inverted truncated conical shape is fitted to the locking jaw portion of the mouth-and-neck portion gradually, rather than sharply. Thus, the situation where not only the required initial torque but also the required secondary torque becomes excessively high is avoided or suppressed to the utmost, and the tendency toward a sharp increase in the required torque is avoided. When the locking means is locked to the locking jaw portion, moreover, the fitting surface remains sufficiently locked to the locking jaw portion, thus fully reliably preventing the slipping-out phenomenon in which the locking means ascends while elastically climbing over the locking jaw portion, without causing the breakage of the circumferential breakable line.

In the preferred embodiment in which the axial clearance C between the external thread and the internal thread is set to be equal to or greater than the axial effective width W of the locking jaw portion (i.e., $C \geq W$), when the locking ridge formed on the inner peripheral surface of the tamper evident bottom section of the closure climbs over the locking jaw portion formed on the outer peripheral surface of the mouth-and-neck portion of the container, the internal thread engaged with the lower side of the external thread is displaced toward the upper side of the external thread located below the internal thread. Thus, application of force to the circumferential breakable line of the skirt wall is avoided, so that the breakage of the bridge portions in the circumferential breakable line is maximally prevented.

MODE FOR CARRYING OUT THE INVENTION

Preferred embodiments of a synthetic resin container closure constituted in accordance with the present invention, and a combination of such a container closure and a container will now be described in further detail by reference to the accompanying drawings.

Figure 1:
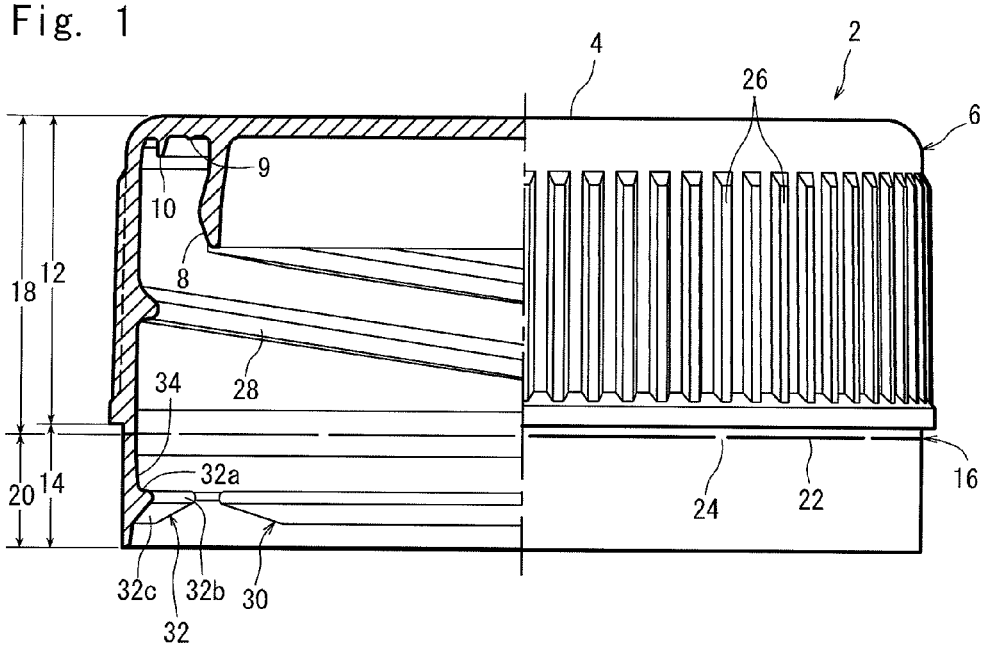
FIG. 1 is a front view showing, partly in section, a preferred embodiment of a synthetic resin container closure constituted in accordance with the present invention.

With reference to FIG. 1, a container closure 2, which can be injection-molded or compression-molded from a suitable synthetic resin such as polyethylene or polypropylene, includes a circular top panel wall 4, and a cylindrical skirt wall 6 extending downwardly from the peripheral edge of the top panel wall 4. A cylindrical inner sealing piece 8 extending downward, and a cylindrical outer sealing piece 10 similarly extending downward are formed on the inner surface of the top panel wall 4. Further, a relatively small annular ridge 9 is formed between the inner sealing piece 8 and the outer sealing piece 10.

The skirt wall 6 has a relatively thick-walled thick-wall upper portion 12 and a relatively thin-walled thin-wall lower portion 14. A circumferential breakable line 16 extending in the circumferential direction is formed in an upper end part of the thin-wall lower portion 14. The skirt wall 6 is divided into a main section 18 above the circumferential breakable line 16, and a tamper evident bottom section 20 below the circumferential breakable line 16. The circumferential breakable line 16 in the illustrated embodiment is composed of a plurality of slits 22 extending in the circumferential direction at circumferentially spaced locations, and a plurality of bridge portions 24 located between the slits 22.

Non-slip knurls 26 composed of concavities and convexities alternately present, as viewed in the circumferential direction, are formed on the outer peripheral surface of the main section 18 of the skirt wall 6. Three internal threads 28 are formed on the inner peripheral surface of the main section 18 of the skirt wall 6. The three internal threads 28 are arranged at an angular distance of 120 degrees, and each of the three internal threads 28 extends over an angular range of nearly 160 degrees. A locking means 30 is disposed on the inner peripheral surface of the tamper evident bottom section 20. In the illustrated embodiment, the locking means 30 is formed from five protrusions 32 arranged with spacing in the circumferential direction and extending in the circumferential direction. A main part of each of the protrusions 32 (the part excluding both end parts of the protrusion) has a longitudinal sectional shape, which is a nearly right-angled triangular shape, and has an upper surface 32*a* extending radially inwardly at a slightly downward incline, an inner surface 32*b* of a nearly arcuate shape, and a lower surface 32*c* extending downward at a radially outward incline.

Figure 2:
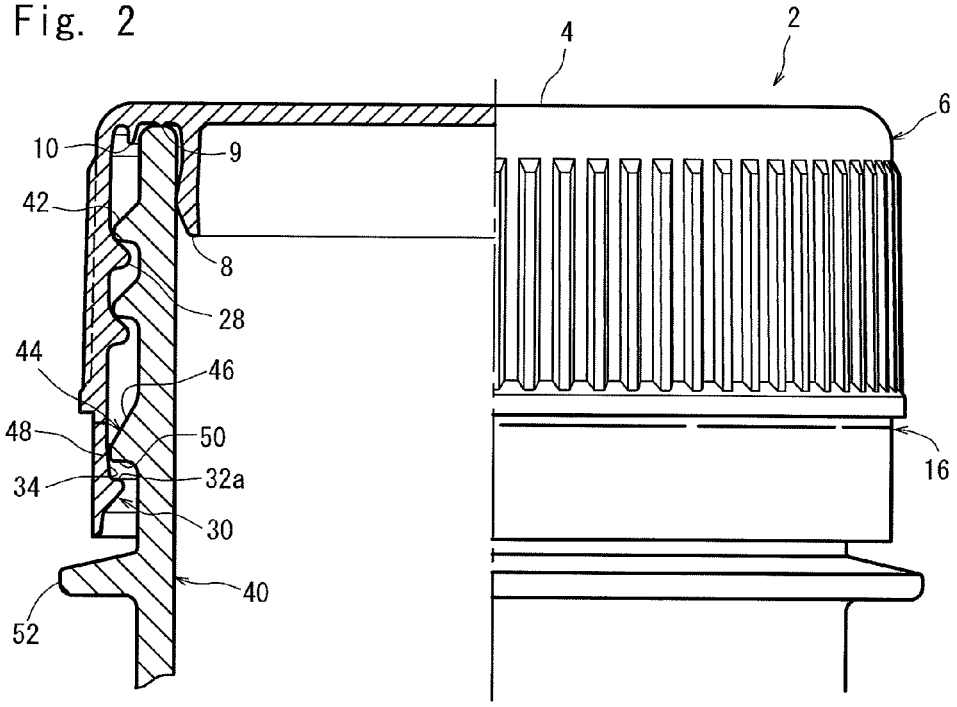
FIG. 2 is a front view showing, partly in section, a state where the container closure of FIG. 1 has been mounted on a mouth-and-neck portion of a container.
Figure 3:
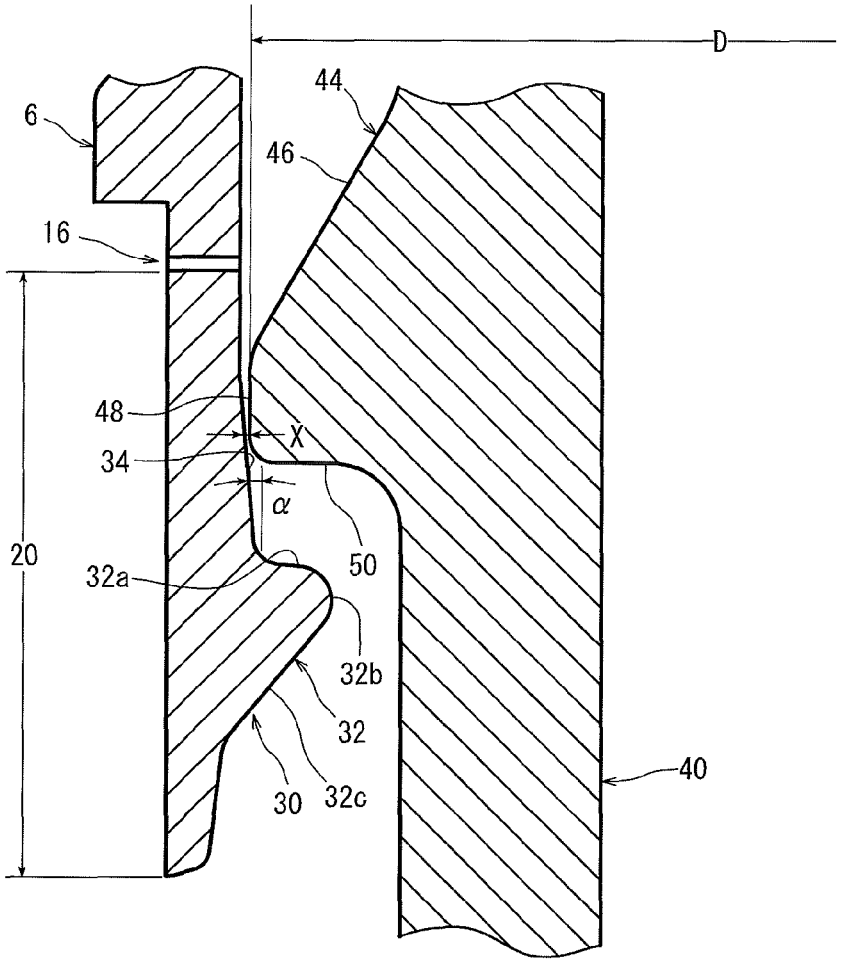
FIG. 3 is an enlarged fragmentary sectional view showing, on an enlarged scale, a part of FIG. 2.

With further reference to FIGS. 2 and 3 along with FIG. 1, it is important that a fitting surface 34 of an inverted truncated conical shape extending upward at a radially outward incline from the base edge of the upper surface 32*a* of the locking means 30, namely, the left end edge in FIG. 3 which is the boundary line between the upper surface 32*a* and the inner peripheral surface of the tamper evident bottom section 20, be disposed in the inner peripheral surface of the tamper evident bottom section 20. The inclination angle a of the fitting surface 34 with respect to the central axis line is preferably of the order of 3 to 15 degrees. This fitting surface 34 can be formed locally in correspondence with the site where the locking protrusions 32 constituting the locking means 30 are present. However, the fitting surface 34 is preferably formed throughout the periphery in the circumferential direction.

FIG. 2 illustrates a mouth-and-neck portion 40 of a container as well as the container closure 2. The mouth-and-neck portion 40 of the container, which can be formed from a suitable synthetic resin such as polyethylene terephthalate, glass, or a metal sheet, is in a cylindrical shape as a whole. Three external threads 42, and a locking jaw portion 44 located below the external threads 42 are formed on the outer peripheral surface of the mouth-and-neck portion 40. The three external threads 42 are formed in correspondence with the above-mentioned three internal threads 28 in the container closure 2, and are arranged at an angular distance of 120 degrees, and each extend over an angular range of nearly 160 degrees. The locking jaw portion 44 has a truncated cone-shaped upper surface 46 gradually increasing in outer diameter in a downward direction, an outer peripheral surface 48 of a cylindrical shape, and a lower surface 50 extending substantially horizontally. On the outer peripheral surface of the mouth-and-neck portion 40, there is further disposed a support ring 52 located below the locking jaw portion 44 (such a support ring 52 is utilized for transportation of the container, as is well known among people skilled in the art).

In the illustrated embodiment, it is important that the width of the internal thread 28 formed on the inner peripheral surface of the main section 18 in the skirt wall 6 of the closure 2 be set to be relatively small, and that the axial clearance C (see FIG. 4-C) between the external thread 42 formed on the outer peripheral surface of the mouth-and-neck portion 40 and the internal thread 28 formed on the inner peripheral surface of the main section 18 of the skirt wall 6 of the closure 2 be set to be equal to or larger than the axial effective width W of the locking jaw portion 44 (i.e., the axial dimension of the outer peripheral surface 48). It is preferred that the difference between the axial clearance C and the axial effective width W be of the order of 0.0 to 0.7 mm (C−W=0.0 to 0.7 mm). The width H of the internal thread 28 is advantageously of the order of 1.0 to 1.6 mm from the standpoints of moldability (e.g., avoidance of thread roll-over) and the drop impact resistance of the combination. Also advantageously, the difference between the inner diameter Dc1 of the root of the internal thread 46 and the outer diameter Dc2 of the crest of the external thread 6, namely, Dc1-Dc2, is of the order of 0.1 to 0.7 mm.

Figure 4:
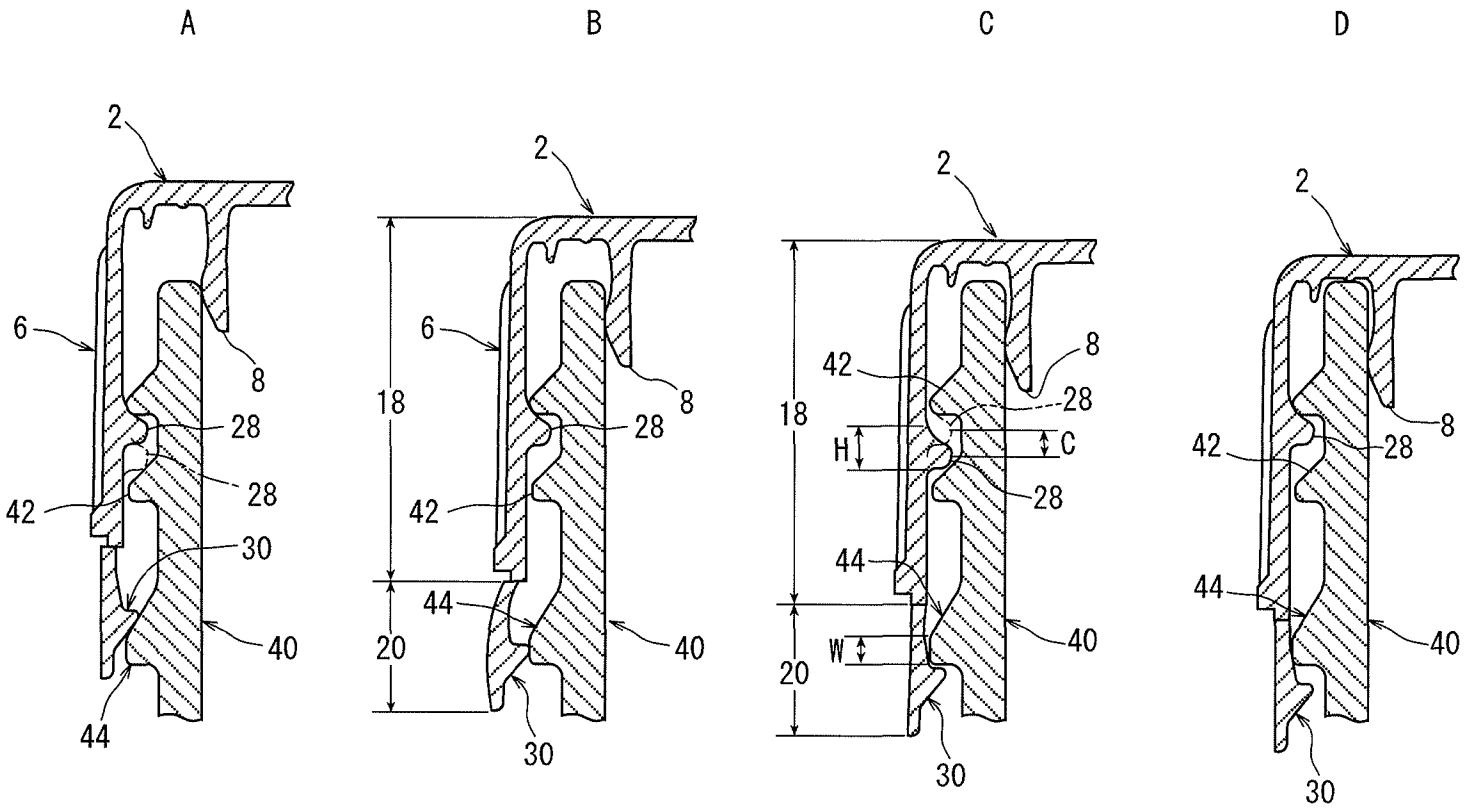
FIGS. 4-A to 4-D are fragmentary sectional views for illustrating behaviors when the container closure shown in FIG. 1 are mounted on the mouth-and-neck portion of the container.

In sealing the mouth-and-neck portion 40 by mounting the closure 2 on the mouth-and-neck portion 40 after filling the contents into the container, the closure 2 is fitted over the mouth-and-neck portion 40, and the closure 2 is rotated in a closing rotational direction, clockwise as viewed from above in FIG. 2, to screw the internal thread 28 of the closure 2 onto the external thread 42 of the mouth-and-neck portion 40. As the screwing of the internal thread 28 onto the external thread 42 proceeds, the closure 2 is gradually lowered. When the closure 2 is lowered to a position as shown in FIG. 4-A, the inner sealing piece 8 advances into the mouth-and-neck portion 40, and is brought into intimate contact with the inner peripheral surface of the mouth-and-neck portion 40. As a result, resistance to the descent of the closure 2 is generated, whereby the closure 2 is changed from a state indicated by a dashed double-dotted line in FIG. 4-A, namely, a state where the internal thread 28 engages the upper side of the external thread 42, into a state indicated by a solid line in FIG. 4-A, i.e., a state where the internal thread 28 engages the lower side of the external thread 42. When the closure 2 is lowered to a position shown in FIG. 4-B, the locking means 30 of the closure 2 rides on the outer peripheral surface 48 of the locking jaw portion 44 of the mouth-and-neck portion 40 mainly by the elastic deformation of the tamper evident bottom section 20. When the closure 2 is further lowered, the locking means 30 crosses the locking jaw portion 44, as shown in FIG. 4-C. At this instant, a downward force is generated in the skirt wall 6 through the cooperation of the locking jaw portion 44 and the locking means 30 crossing it. Owing to this downward force, the internal thread 28 is displaced from a state indicated by a dashed double-dotted line in FIG. 4-C, i.e., a state where the internal thread 28 engages the lower side of the external thread 42, to a state indicated by a solid line in FIG. 4-C. In the illustrated embodiment, the axial clearance C between the external thread 42 and the internal thread 28 is set to be equal to or greater than the axial effective width W of the locking jaw portion 44, as stated earlier. Thus, the internal thread 28 does not make intimate contact with the upper side of the external thread 42. Hence, excessive stress is not caused to the circumferential breakable line 16, particularly, its bridge portions 24, so that the breakage of the bridge portions 24 is prevented at the maximum. When the closure 2 is lowered to a position shown in FIG. 4-D and mounted on the mouth-and-neck portion 40 as required, the internal thread 28 is brought into engagement with the lower side of the external thread 42 again.

In the conventional combinations, the axial clearance between the external thread and the internal thread is smaller than the axial effective width of the locking jaw portion. Thus, at the very moment when the locking means climbs over the locking jaw portion, a downward force is exerted on the skirt wall to displace the internal thread downward, whereupon the internal thread is brought into intimate contact with the upper side of the external thread. Thus, a downward force is generated in the skirt wall through the cooperation of the locking jaw portion and the locking means crossing it. Moreover, an upward force is applied to the skirt wall through cooperation between the external thread and the internal thread in intimate contact with its upper side. Consequently, excessive stress is caused to the bridge portions in the circumferential breakable line, developing a tendency toward breakage of the bridge portions.

With further reference to FIG. 3 along with FIG. 2, in the state where the container closure 2 has been mounted, as required, on the mouth-and-neck portion 40, namely, in the state as illustrated in FIGS. 2 and 3, it is preferred that the upper end of the fitting surface 34 disposed on the inner peripheral surface of the tamper evident bottom section 20 be located above the lower end of the outer peripheral surface 48 of the locking jaw portion 44, and in particular, be located opposite a site above an intermediate part in the central axis direction of the outer peripheral surface 48, but below the upper end of the outer peripheral surface 48. In the state illustrated in FIG. 3, it is preferred that a clearance x, advantageously, of the order of 0.0 mm≤x≤0.2 mm at the minimum be present between the fitting surface 34 and the outer peripheral surface 48 of the locking jaw portion 44.

Figure 5:
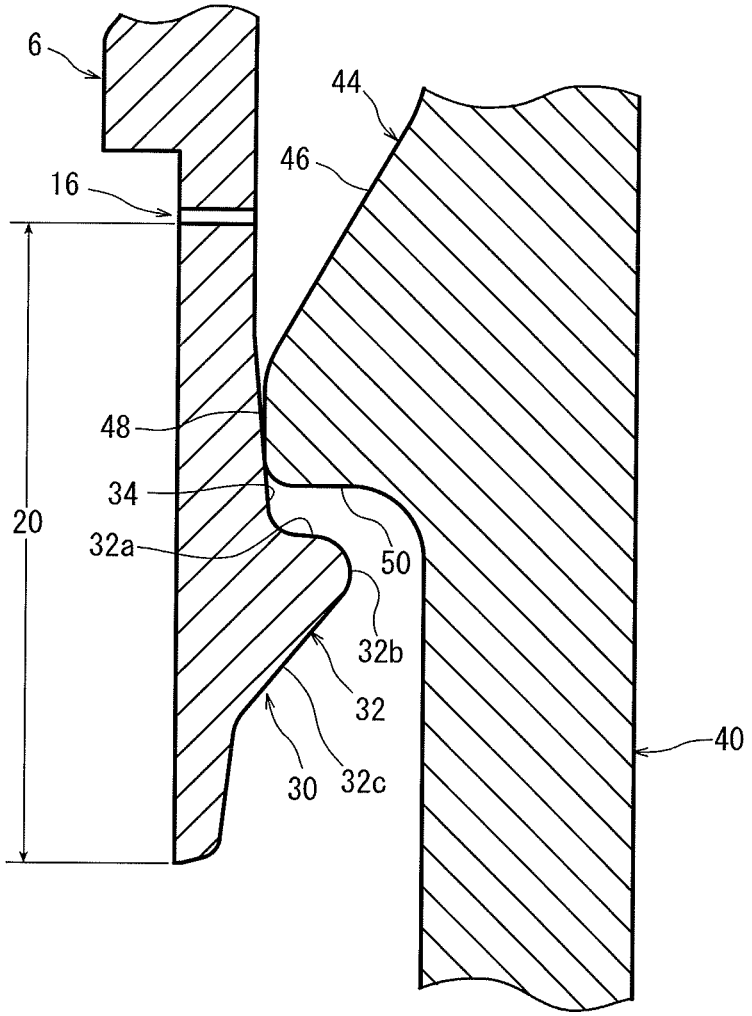
FIG. 5 is an enlarged fragmentary sectional view, similar to FIG. 3, in a state where the container closure has been somewhat rotated in an opening rotational direction from the state shown in FIGS. 2 and 3.
Figure 6:
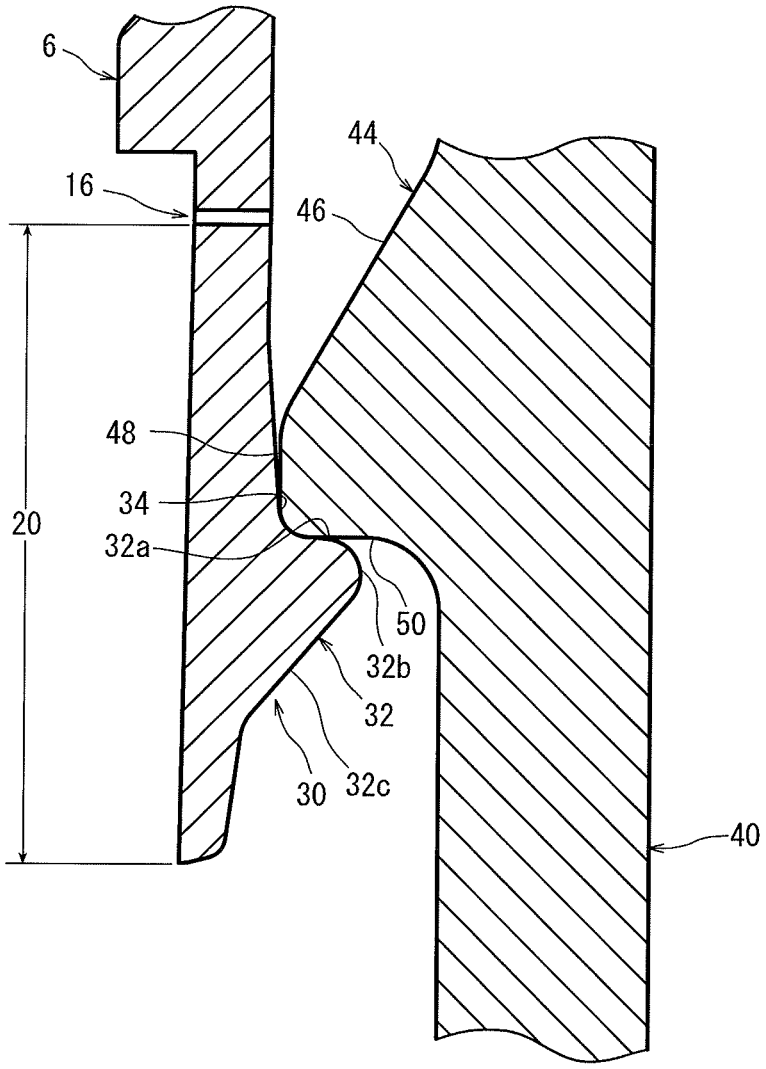
FIG. 6 is an enlarged fragmentary sectional view, similar to FIGS. 3 and 5, in a state where the container closure has been somewhat rotated further in the opening rotational direction from the state shown in FIG. 5.

In unsealing the mouth-and-neck portion 40 in order to consume the contents, the container closure 2 is rotated in an opening direction, namely, counterclockwise as viewed from above in FIG. 3. At the initial stage of such a rotation, the above-mentioned clearance x exists between the fitting surface 34 formed in the inner peripheral surface of the tamper evident bottom section 20 and the outer peripheral surface 48 of the locking jaw portion 44, so that required initial torque does not become excessively high. When the container closure 2 is somewhat rotated in the opening rotational direction to raise the container closure 2, relative to the mouth-and-neck portion 40, to a position shown in FIG. 5, the fitting surface 34 disposed in the inner peripheral surface of the tamper evident bottom section 20 contacts a lower end part of the outer peripheral surface 48 of the locking jaw portion 44. Then, in accordance with the ascent of the container closure 2, the contact pressure between the fitting surface 34 and the outer peripheral surface 48 of the locking jaw portion 44 is gradually increased. The contact pressure between the fitting surface 34 and the outer peripheral surface 48 of the locking jaw portion 44 does not sharply increase, but is gradually increased in accordance with the ascent of the container closure 2, as will be understood from the Example and Comparative Example to be described later. Furthermore, required secondary torque during breakage of the circumferential breakable line 16 is prevented or maximally inhibited from becoming excessively high. When the container closure 2 is further rotated in the opening direction from the state illustrated in FIG. 5 to raise the container closure 2, relative to the mouth-and-neck portion 40, to a position shown in FIG. 6, the upper end surface 32*a* of the protrusion 32 constituting the locking means 30 disposed on the inner peripheral surface of the tamper evident bottom section 20 contacts the lower surface 50 of the locking jaw portion 44 of the mouth-and-neck portion 40. When the container closure 2 is further rotated in the opening direction from the state shown in FIG. 6, the ascent of the tamper evident bottom section 20 is impeded, because the locking means 30 of the container closure 2 keeps contacted with or locked to the locking jaw portion 44 of the mouth-and-neck portion 40. Hence, stress is generated in the circumferential breakable line 16, more particularly, its bridge portions 24, so that the circumferential breakable line 16 is broken, whereby the tamper evident bottom section 20 is separated from the main section 18 of the skirt wall 6. When the circumferential breakable line 16 is broken, the elastic deformation or displacement of the tamper evident bottom section 20 is suppressed, because the fitting surface 34 disposed in the inner peripheral surface of the tamper evident bottom section 20 is interference-fitted to the outer peripheral surface 48 of the locking jaw portion 44. Thus, a situation where the locking means 30 ascends and climbs over the locking jaw portion 44, without breakage of the circumferential breakable line 16, is avoided fully reliably. After the circumferential breakable line 16 is broken and the tamper evident bottom section 20 is separated from the main section 18 of the skirt wall 6, the parts of the container closure 2 excluding the tamper evident bottom section 20 are raised in accordance with the rotation of the container closure 2 in the opening direction. The tamper evident bottom section 20 remains on the mouth-and-neck portion 40, while the container closure 2 is released from the mouth-and-neck portion 40. In this manner, the mouth-and-neck portion 40 is unsealed.

In the illustrated embodiment, at the time of unsealing of the mouth-and-neck portion 40, the circumferential breakable line 16 is broken in the entire circumferential direction, and the tamper evident bottom section 20 is completely separated from the main section 18 of the skirt wall 6. If desired, however, there can be realized a configuration in which an additional break line extending in the axial direction is formed in the tamper evident bottom section 20; in unsealing the mouth-and-neck portion 40, the bridge portions 24 in the circumferential breakable line 16 are not locally broken, but are allowed to remain, and the tamper evident bottom section 20 continues to be connected to the main section 18 of the skirt wall 6; and the additional break line of the tamper evident bottom section 20 is broken to spread the tamper evident bottom section 20 in the form of a strip having ends, releasing the locking of the locking means 30 to the locking jaw portion 44, whereby the entire container closure 2 including the tamper evident bottom section 20 is removed from the mouth-and-neck portion 40.

Figure 7:
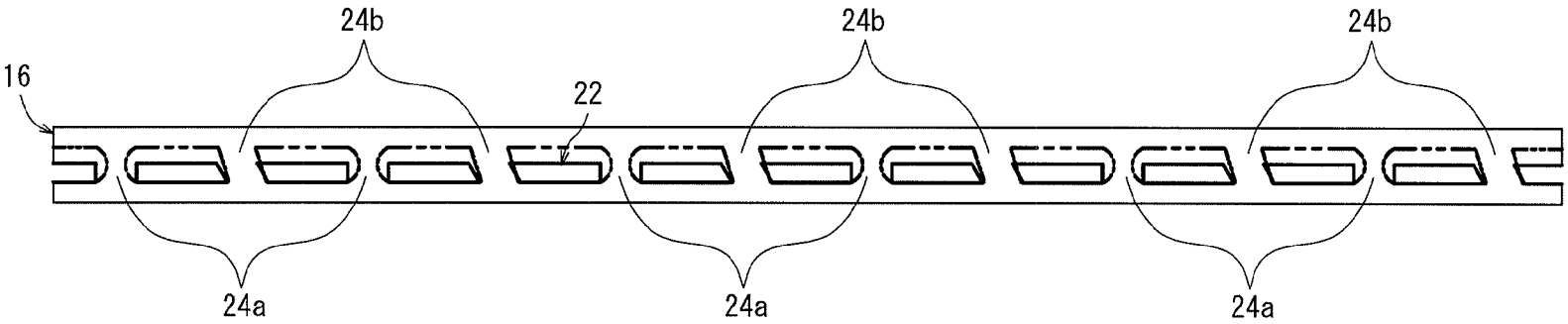
FIG. 7 is an enlarged developed view showing a modification of a circumferential breakable line.

FIG. 7 illustrates a modification of the circumferential breakable line 16. The circumferential breakable line 16 of a modified configuration is composed of a plurality of slits 22 extending in the circumferential direction at circumferentially spaced locations, and a plurality of bridge portions 24*a* and 24*b* located between the slits 22. The plurality of bridge portions 24 include the bridge portions 24*a* each configured such that its circumferentially opposite end edges extend substantially parallel to the central axis line (accordingly, substantially vertically), and the bridge portions 24*b* each configured such that its circumferentially opposite end edges are inclined in a predetermined direction with respect to the central axis line. The bridge portions 24*a* and the bridge portions 24*b* are alternately located. (In the configuration illustrated in FIG. 1, the circumferentially opposite end edges of all the bridge portions 24 extend substantially parallel to the central axis line.) In the circumferential breakable line 16 of such a configuration, when stress is applied in the axial direction to break the bridge portions 24*a* and 24*b*, each bridge portion 24*a* has its circumferential width gradually narrowed from the beginning and is broken, as indicated by dashed double-dotted lines in FIG. 6. Each bridge portion 24*b*, on the other hand, is initially deformed in a direction in which its circumferentially opposite end edges are rendered parallel to the central axis line, whereafter the bridge portion 24*b* has its circumferential width gradually narrowed and is broken, also as indicated in the drawing. Thus, the bridge portions 24*a* are broken, and then the bridge portions 24*b* are broken. With this manner of breakage, compared with a manner in which all the bridge portions are broken substantially simultaneously, maximum stress necessary for the breakage of the bridge portions 24*a* and 24*b* is reduced, and so-called required secondary torque can be further decreased.

Example: Three container closures substantially identical with the container closure illustrated in FIG. 1 were formed from polyethylene by injection molding. In each of the molded container closures, the nominal diameter thereof was 30 mm, the thickness of the thin-wall lower portion of the skirt wall was 0.5 mm, the inclination angle of the fitting surface formed in the inner peripheral surface of the tamper evident bottom section was 5 degrees, and the inner diameter of the tamper evident bottom section in the region where the fitting surface existed was 29.95 mm at the lower end of the fitting surface and 30.35 mm at the upper end of the fitting surface.

Figure 9:
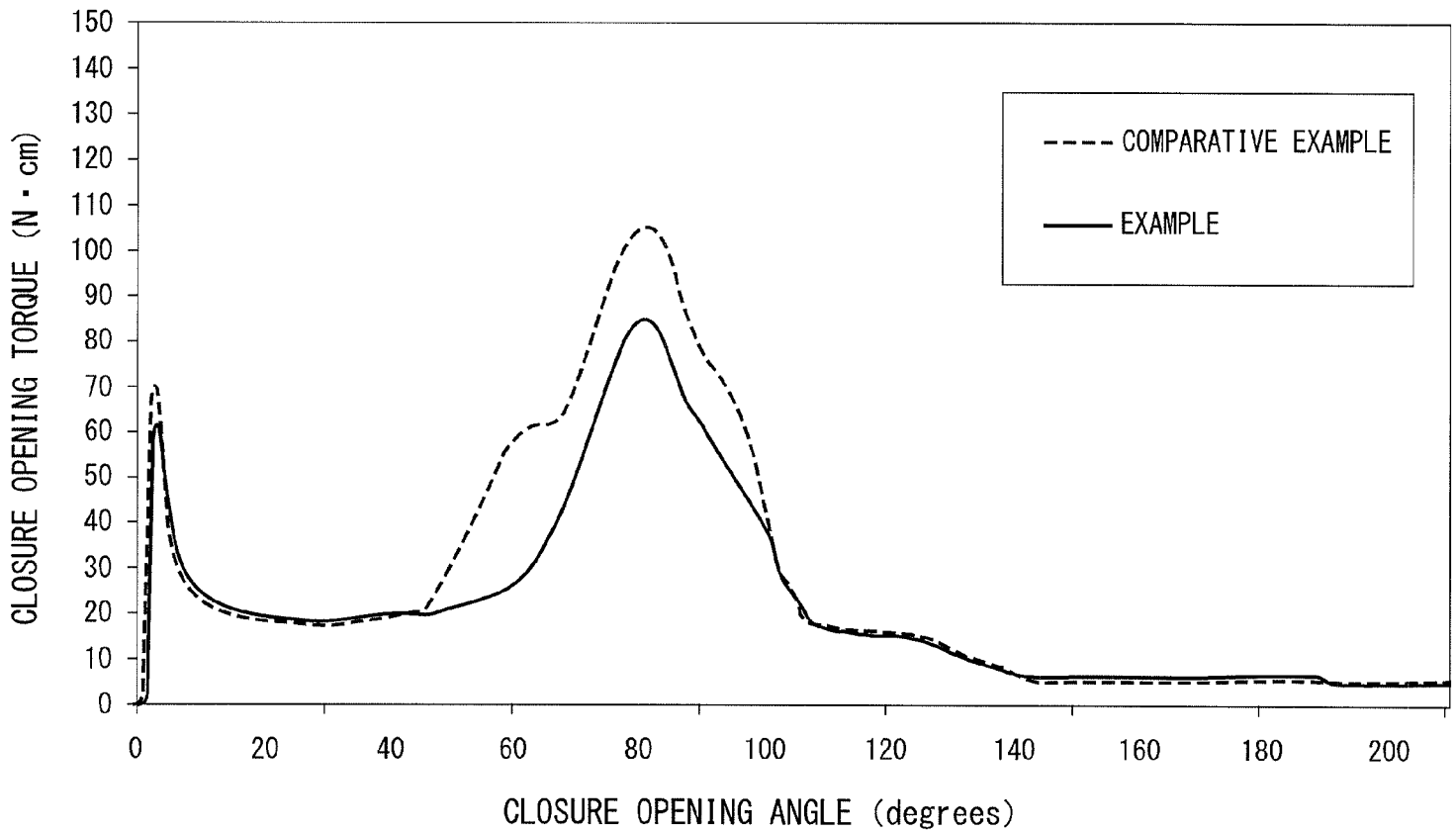
FIG. 9 is a chart showing changes in required torque in an Example and the Comparative Example.

The container closure as described above was mounted on the mouth-and-neck portion, as shown in FIG. 3, of a container molded from polyethylene terephthalate. The outer diameter D of the locking jaw portion of the mouth-and-neck portion was 30.2 mm, and the clearance between the fitting surface and the outer peripheral surface of the locking jaw portion was 0.0 mm. The container closure mounted on the mouth-and-neck portion was rotated in the opening rotational direction to break the breakable line of the container closure, whereupon the tamper evident bottom section was allowed to remain, while the other parts of the container closure were removed from the mouth-and-neck portion. The relationship between changes in the require torque for the above opening procedure and the rotational angle of the container closure during this procedure was measured using a rotating torque meter. Measurements were made for each of the three container closures, and the average values were calculated. The results are as shown in FIG. 9. The required secondary torque was nearly the same as the required initial torque.

Figure 8:
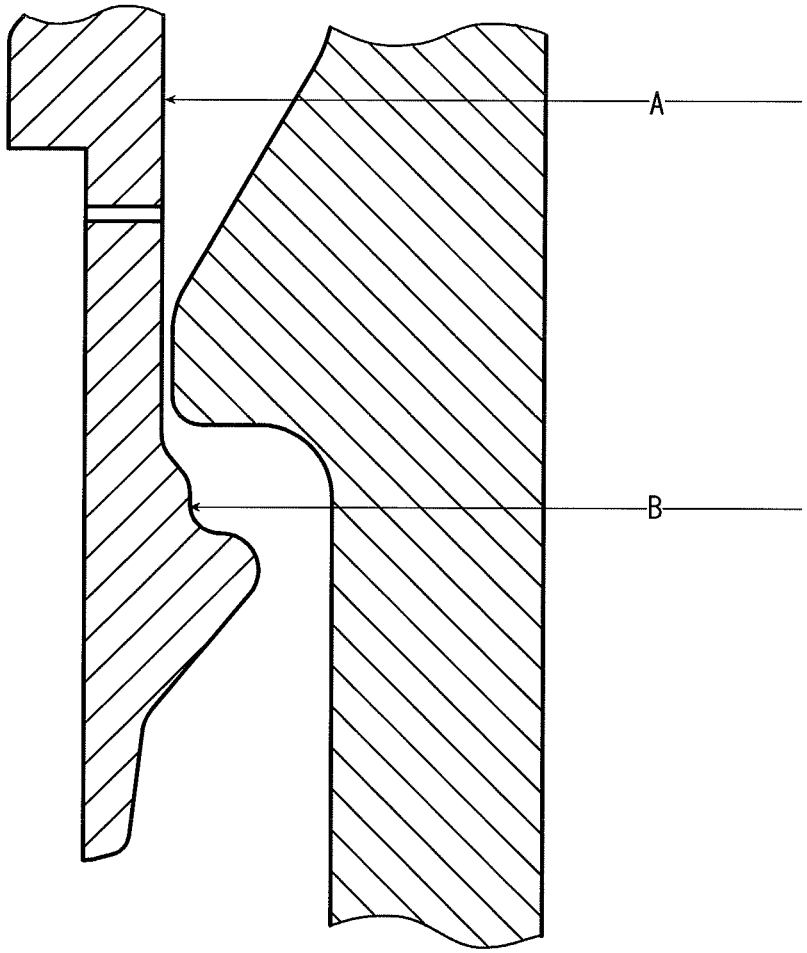
FIG. 8 is an enlarged fragmentary sectional view, similar to FIG. 3, showing on an enlarged scale a part of a container closure used in a Comparative Example.

Comparative Example: For comparison, three container closures were formed which were the same as those in the Example, except that the shape of a site above the locking means in the inner peripheral surface of the tamper evident bottom section was as shown in FIG. 8; a loosely fitting portion A located above and a fitting portion B located below were formed; and the inner diameter of the loosely fitting portion A was 30.35 mm, while the inner diameter of the fitting portion B was 29.95 mm. In the same manner as in the Example, the relationship between changes in the require torque and the rotational angle of the container closure was measured using a rotating torque meter. Measurements were made for each of the three container closures, and the average values were calculated. The results are as shown in FIG. 9. The required secondary torque was considerably high compared with the required initial torque.

EXPLANATIONS OF LETTERS OR NUMERALS

2: Container closure
4: Top panel wall
6: Skirt wall
16: Circumferential breakable line
18: Main section of skirt wall
20: Tamper evident bottom section
28: Internal thread
30: Locking means
34: Fitting surface
40: Mouth-and-neck portion of container
42: External thread
44: Locking jaw portion

The invention claimed is:

1. A combination of a container and a synthetic resin container closure, in which the container has a cylindrical mouth-and-neck portion; and an external thread and a locking jaw portion located below the external thread are formed on an outer peripheral surface of the mouth-and-neck portion, and the synthetic resin container closure is mounted on the mouth-and-neck portion of the container, and includes a circular top panel wall and a cylindrical skirt wall extending downwardly from a peripheral edge of the top panel wall; a circumferential breakable line extending in a circumferential direction is formed in the skirt wall; the skirt wall is divided into a main section above the circumferential breakable line and a tamper evident bottom section below the circumferential breakable line; an internal thread to cooperate with the external thread of the mouth-and-neck portion is formed on an inner peripheral surface of the main section; and a lock to cooperate with the locking jaw portion of the mouth-and-neck portion is disposed on an inner peripheral surface of the tamper evident bottom section, wherein an inverted truncated cone-shaped fitting surface, which extends upwards at a radially outward incline from a base edge of an upper surface of the lock, is disposed in the inner peripheral surface of the tamper evident bottom section of the synthetic resin container closure, with the internal thread of the synthetic resin container closure being screwed onto the external thread of the mouth-and-neck portion to mount the synthetic resin container closure on the mouth-and-neck portion, thereby sealing the mouth-and-neck portion, an upper end edge of the fitting surface formed in the inner peripheral surface of the tamper evident bottom section is located to oppose an outer peripheral surface of the locking jaw portion of the mouth-and-neck portion, wherein an axial clearance C between the external thread and the internal thread is equal to or larger than an axial effective width W of the locking jaw portion ($C \geq W$), the axial clearance C is larger than the axial effective width W by 0.0 to 0.7 mm ($C-W=0.0$ to 0.7 mm), and when the closure is rotated in the opening rotational direction, the contact pressure between the fitting surface and the outer peripheral surface of the locking jaw portion is gradually increased before the lock cooperates with the law locking jaw portion.

2. The combination according to claim 1, wherein the fitting surface has an inclination angle of 3 to 15 degrees with respect to a central axis line.

3. The combination according to claim 1, wherein with the internal thread of the synthetic resin container closure being screwed onto the external thread of the mouth-and-neck portion to mount the synthetic resin container closure on the mouth-and-neck portion, thereby sealing the mouth-and-neck portion, a clearance x, at a minimum, of $0.0\ \text{mm} \leq x \leq 0.2$ mm is present between the outer peripheral surface of the locking jaw portion and the fitting surface.

* * * * *